US005996231A

United States Patent [19]

Roche et al.

[11] Patent Number: 5,996,231

[45] Date of Patent: Dec. 7, 1999

[54] SCRAPING TOOL WITH REPLACEABLE BLADE AND CONTROLLED QUICK-RELEASE CLAMP

[75] Inventors: David E. Roche, Nashua; Mark E. Baerenrodt, Milford, both of N.H.; David H. Mallalieu, Springfield, Mass.; Mark T. Panaccione, Tigard, Oreg.

[73] Assignee: Hyde Tools, Southbridge, Mass.

[21] Appl. No.: 08/907,292

[22] Filed: Aug. 6, 1997

[51] Int. Cl.[6] ..... B26B 5/00

[52] U.S. Cl. ..... 30/169; 30/329; 30/333

[58] Field of Search ..... 30/151, 162, 169, 30/329, 330, 332, 333

[56] References Cited

U.S. PATENT DOCUMENTS

| | | | |
|---|---|---|---|
| D. 346,319 | 4/1994 | La Vallee | D8/99 |
| 2,233,184 | 2/1941 | Rufleth | 30/329 |
| 2,291,514 | 7/1942 | Warner et al. | 30/169 |
| 3,855,700 | 12/1974 | Gersone et al. | 30/169 |
| 4,558,517 | 12/1985 | Gringer | 30/169 |
| 4,575,936 | 3/1986 | Gringer | 30/169 |
| 4,955,138 | 9/1990 | Henke et al. | 30/169 |
| 5,056,226 | 10/1991 | Gringer | 30/169 |
| 5,433,004 | 7/1995 | Thompson et al. | 30/169 |
| 5,528,832 | 6/1996 | Schmidt | 30/169 |

*Primary Examiner*—Hwel-Siu Payer
*Attorney, Agent, or Firm*—Ronald R. Kilponen

[57] ABSTRACT

A scraping tool employing a sharp-edged blade such as a wallpaper shaving blade, utility or razor blade; comprising an integral body and handle, a controllable quick-release blade clamp and latching level to lock and unlock the clamp for access to the blade. Both the clamp and lever are pivotably connected to the body/handle component using the "snap-fit" technique. The tool includes an integral resilient member for maintaining the clamp closed whenever the tool is unlocked, such that the blade will be retained at all times, until the clamp is purposefully actuated by the user for installation or removal of the blade.

16 Claims, 16 Drawing Sheets

SCRAPING TOOL WITH REPLACEABLE BLADE AND CONTROLLED QUICK-RELEASE CLAMP

FIELD OF THE INVENTION

This invention relates generally to scraping tools of the type that employ replaceable sharp-edged blades such as razor, utility and wallpaper shaver blades and others.

1. Background

A wide variety of prior art tool heads and blade clamps exist in the field of this invention. Some examples of prior art include, generally, clamps having two jaws, or lips, that are attached to each other by one or more screws, thus necessitating a screwdriver or some other suitable implement to assemble or replace a blade. Such clamps may retain the blade solely bad the friction resulting from the clamping force, or, as in some models, by one or more interlocking detents in one of the clamping surfaces that engage a mating hole or holes in the blade. These types of clamps are usually found on wallpaper shaving tools.

The design of these types of tools make the removal and replacement of blades inconvenient. In order to replace a worn blade, a user must have another tool such as a screwdriver or Allen wrench to loosen the attachment screw (s). Once the screw(s) are loosened, the blade is released and there is an increased probability that the blade will fall from the clamp onto the floor or ground. The user must then pick it up for safe disposal. The screw(s) can also be inadvertently loosened so much that they fall out of the clamp onto the floor or ground, increasing the probability of their becoming lost. This results in wasted time finding the lost or a new screw, or if not found, the user might unsafely or inefficiently operate the scraper with less screws than designed.

Further, some users tend to hold the tool up in the air with one hand while tightening or loosening the screws with the other. It's possible even to cradle the clamp in either hand so as to employ the thumb and forefinger as guides for the edges of the blade, maintaining its position and alignment while the clamp is loose. Users could more easily lose their grip on the screwdriver of the scraping tool when handling them in this manner, resulting in bodily injury.

There are many other types of prior art clamps for utility, razor and other styles of blades employed in scraping tools, all having deficiencies of one type or another, as noted in the ensuing descriptions. Particularly hazardous are razor blade scrapers incorporating spring clamps that pinch the blade, necessitating the user to forcefully push the sharp blade between the pinching lips of the clamp.

2. Description of Prior Art

Donald Gringer's U.S. Pat. No. 4,575,936 (the '936 patent) issued Mar. 18, 1986, titled "Blade Retaining Tool Head" attempts to remedy the hazard and inconvenience of the prior art screw-type clamp. This is done by employing interlocking, pivoting clamp-halves that are actuated by a threaded handle which engages mating threads in each clamp-half. A filled-in thread in one of the clamp-halves augments a camming action that forces the two halves together to grip an inserted blade when the handle is fully tightened. This eliminates the need for screws and a screwdriver or other tools to perform this function.

Gringer's '936 patent, however, provides no means for retaining the blade while the clamp is being actuated, perpetuating the potential hazard caused by a user's tendency to guide the edges of the blade into alignment with the clamp with one hand while tightening or loosening the threaded handle with the other.

The actual product bearing the '936 patent number, though, incorporates a feature that both augments tighter closing of the clamp halves and sustains sufficient pressure on each half of the clamp during the tightening or loosening process to prevent the blade from slipping or falling out of the clamp. This is accomplished by a small ¼×¼ resilient cylinder loosely assembled in the "socket" formed by the two threaded portions of the clamp-halves. As the handle is tightened, the resilient cylinder is compressed. Its expanded girth presses against each clamp-half, augmenting closure.

The user must purposefully apply a nominal amount of thumb pressure to a designated point on the rearward portion of the clamp in order to force it open to release or install a blade. Having thus assembled a blade, the user need provide it no further guidance as he/she torques the handle to firmly tighten and lock the clamp. Whether or not it was purposefully intended to provide the secondary function of restraining the blade during the full extent of clamp actuation when either tightening or loosening the clamp, the resilient member is necessary, after fully tightening the handle, to generate sufficient clamping pressure on the blade to hold it firmly in place while being used for its intended purpose.

The resilient member, however, is readily abraded by the end of the threaded handle during repetitive clamp actuation, degrading its ability to function as intended. Further, the intended or even inadvertent disassembly of the handle offers opportunity for the resilient member to fall out of its socket and become lost.

Additionally, the amount of clamping force imposed on the blade, and thus the magnitude of the retaining friction force, depends on the degree of tightening-torque applied to the handle by the user and, of course, the amount of wear on the resilient cylinder. Whether by inexperience, insufficient strength or lack of intuitive insight, the user may fail to apply enough torque to the handle to sufficiently clamp the blade for all aspects of its intended use. Also, when loosening the clamp to change blades, the user may, for the same reasons, inadvertently disassemble the handle from the clamp-halves; an inconvenience, at the least.

Donald Gringer's U.S. Pat. No. 5,056,226, (the '226 patent), issued Oct. 15, 1991, titled "Tool For Carrying a Scraping or Stripping Blade" specifies a two-piece device incorporating a pivotable, lever-actuated blade clamp. The '226 patent requires no auxiliary tool, such as a screwdriver, to install or remove a blade.

But as in Gringer's '936 patent, his '226 patent provides no means for containing or restraining the blade during the period between the time it is placed in the clamp and the time that the lever is latched shut. Hence, the potential inconvenience of a loose blade slipping, or falling from the clamp before it's closed tightly on the blade persists. The actual tool bearing the '226 number, includes two detents in the lower, fixed clamp jaw that engage corresponding holes in the blade, offering a limited amount of blade restraint at times when the lever is unlatched. However, this effect is far from positive blade retention.

The preferred embodiments of both aforementioned Gringer patents ('936 and '226), as well as the actual tools bearing these numbers, employ the so-called "wallpaper shaver" blade.

Another class of clamps for scraping applications are those that incorporate retractable slides upon or within which the blade is placed or inserted.

David Henke et al U.S. Pat. No. 4,995,138 issued Sep. 11, 1990 titled "Utility Blade Scraper" incorporates a thumb button actuated trigger and slide, lockable in three positions:

(1) fully retracted; (2) working position (partial extension) and (3) blade changing position (full extension).

The blade is loaded in the latter position by placing it on the extended slide; a central hole in the blade engaging the slide's mating detent. Additionally, two "lugs" on the slide engage slots in the back edge of the blade. Upon first placing the blade on the slide, it will tend to stay in place as long as the handle is held horizontally, but otherwise may become dislodged and fall, resulting in lost or damaged blades and wasted time and inconvenience. Also, the blade may require some guidance by the user as it is retracted through the blade slot opening. The back edge of the blade may tend to hang-up on the upper edge of the slot, or, in some instances, so may the blade positioning detent. Once retracted into the confines of the slot, the blade is contained by the upper and lower internal surfaces of the slot.

The actual tool that bears the '226 patent number incorporates only two lockable positions for the trigger and slide, rather than the three claimed.

Finally, there's the common razor blade scraper with a myriad of forms and styles. The types most relevant to the field of this invention are the retractable varieties as exemplified by Harry Warner et al Pat. No. 2,291,514 issued Jul. 28, 1942, Donald Gringer Pat. No. 4,558,517 issued Dec. 17, 1985 and Leon Lavallee, et al Pat. No. D346,319 issued Apr. 26, 1994.

These patents specify pinching (spring) type clamps into which the blade must be forcefully inserted by the user; a less than desirable task due to the potential for injury.

For the foregoing reasons, there is a need for a scraping tool with replaceable blade and controlled quick-release clamp.

SUMMARY OF THE INVENTION

Accordingly, it is an object of the present invention to provide a scraping tool that does not exhibit the disadvantages, inconveniences or potential pitfalls from use of the prior art devices previously described.

It is another object of the present invention to provide a scraping tool that requires no auxiliary tool or other implement to assemble, remove or replace a blade.

It is another object of the present invention to provide a scraping tool that requires no auxiliary tool or other implement to place a blade in the "storage" mode; i.e., with its sharp edge reversed so as to be contained within the internal confines of the tool.

An additional object of the present invention is to provide a scraping tool that is readily actuatable, requiring minimal manipulation by the user, and one that freely accepts the blade without the application of any force on the blade other than to set it in place.

Another object of the present invention is to provide a scraping tool with a clamp that restrains the blade from slipping or falling while the clamp is being latched and locked. This relieves the user from the necessity of manually holding or guiding a sharp-edged blade in order to maintain its position in, and alignment with the upper and lower clamps, while being locked.

It is another object of the present invention to provide a scraping tool that when locked generates sufficient clamping pressure to in turn create adequate friction to hold and restrain the blade during all phases of the scraping tool's normal and intended uses.

It is a further object of the present invention to provide a scraping tool having a blade clamp that when latched and locked predictably and consistently generates the design clamping force upon each actuation, not depending, therefore, upon the user's technique, strength, experience or judgment, nor upon an adjustment of any type.

It is a further object of the present invention to provide a scraping tool with a clamping means that can be thumb-actuated, and one whose intended and proper operation is intuitively deducible, to the most feasible degree, by the average user.

An additional object of the present invention is to provide a scraping tool having very few components for ease of manufacture and reasonable cost.

Another object of the present invention is to provide a scraping tool that is readily assembled by hand, requiring no additional tools or fasteners.

Another object of the present invention is to provide a scraping tool that is assembled by hand by the "snap-fit" technique.

An additional object of the present invention is to provide a scraping tool that can be assembled efficiently within the time required to mold the component having the longest molding cycle.

Another object of the present invention is to provide a scraping tool incorporating a thumb-actuated clamping means having a minimum mechanical advantage of about ten (10).

A final object of the present invention is to provide a scraping tool that is strong, yet of minimal weight; no more than approximately ½ pound.

In order to achieve the above objects, as well as others that will become apparent hereinafter to those skilled in the art, a scraping tool in accordance with the present invention comprises three components excluding the blade.

These together with other objects of this invention, along with various features of novelty which characterize this invention, are pointed out with particularity in the claims annexed hereto and forming a part of this disclosure. For a better understanding of this invention, its operating advantages and the specific objects attained by its uses, reference should be had to the accompanying drawings and descriptive matter in which there is illustrated a preferred embodiment.

DETAILED DESCRIPTION OF A PREFERRED EMBODIMENT

Figure 1:
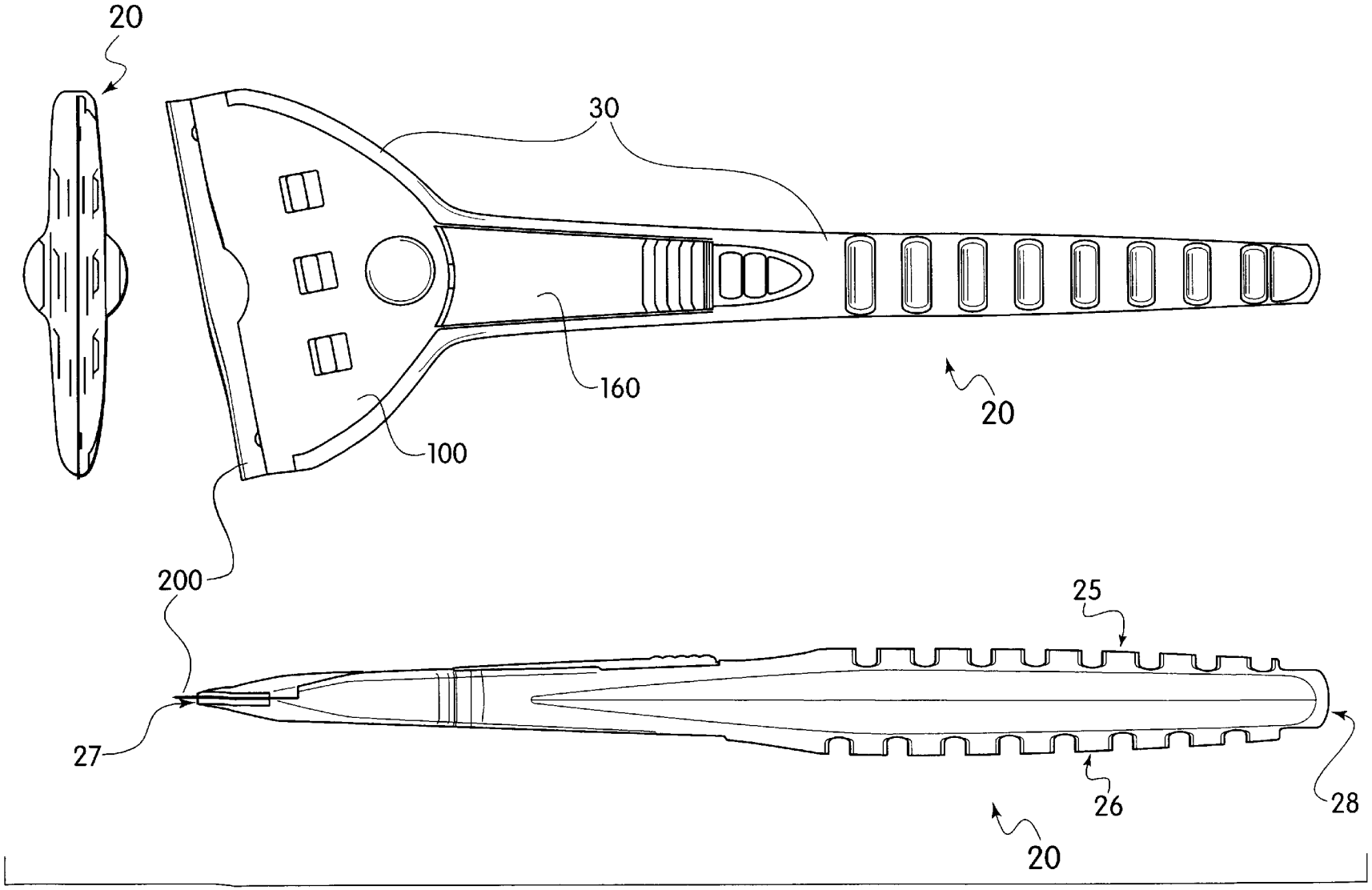
FIG. 1 portrays the "Scraping Tool with Replaceable Blade and Controlled Quick-Release Clamp" (hereinafter: "the Tool") in orthographic projection. Plan, front and side elevation views are depicted with the blade locked in the clamp: sharp edge exposed and "ready-to-use".

Referring to the drawings in detail, wherein like elements are indicated by like numerals, there is shown in FIG. 1 a "Scraping Tool with Replaceable Blade and Controlled Quick-Release Clamp", hereinafter Tool 20. Tool 20 is comprised of three main components: an integral body/handle 30, blade clamp 100 and latching lever 160, each molded from a fiber filled plastic and assembled by the "snap-fit" technique.

Latching lever 160 (hereinafter lever 160) and integral body/handle 30 (hereinafter body 30) cooperatively provide both attachment and pivot means for lever 160. The body 30 has a top surface 25 and a bottom surface 26, a blade end 27 and handle end 28 or handle means. The body/handle 30 in this embodiment is of a one piece design, obviously other configurations could embody a multi-piece body/handle 30 design while still performing the equivalent function.

Figure 4:
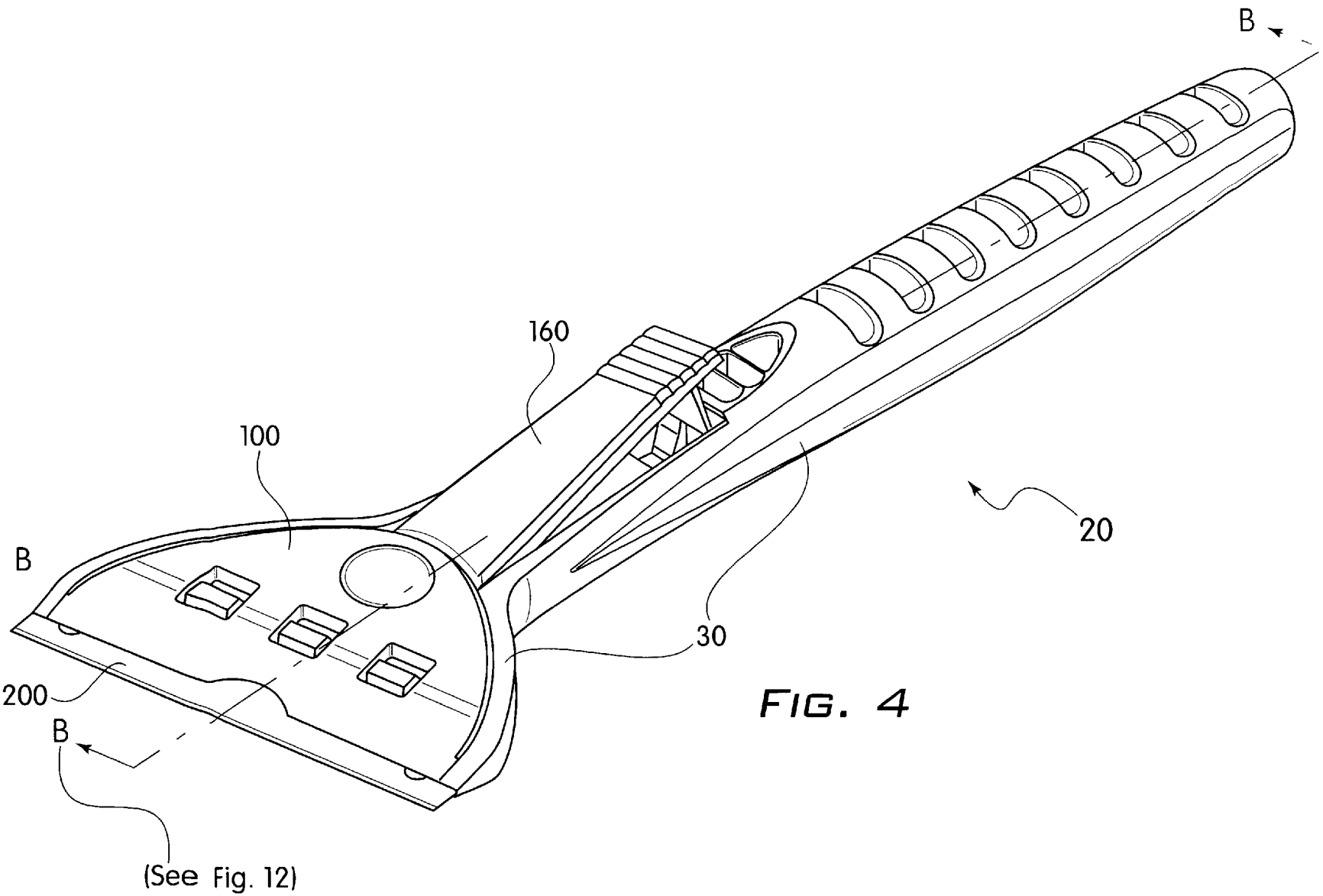
FIG. 4 is a top, front, left-side perspective view showing the lever unlatched, in its most upward position; with blade clamp unlocked, but still closed or in the intermediate position.
Figure 6A:
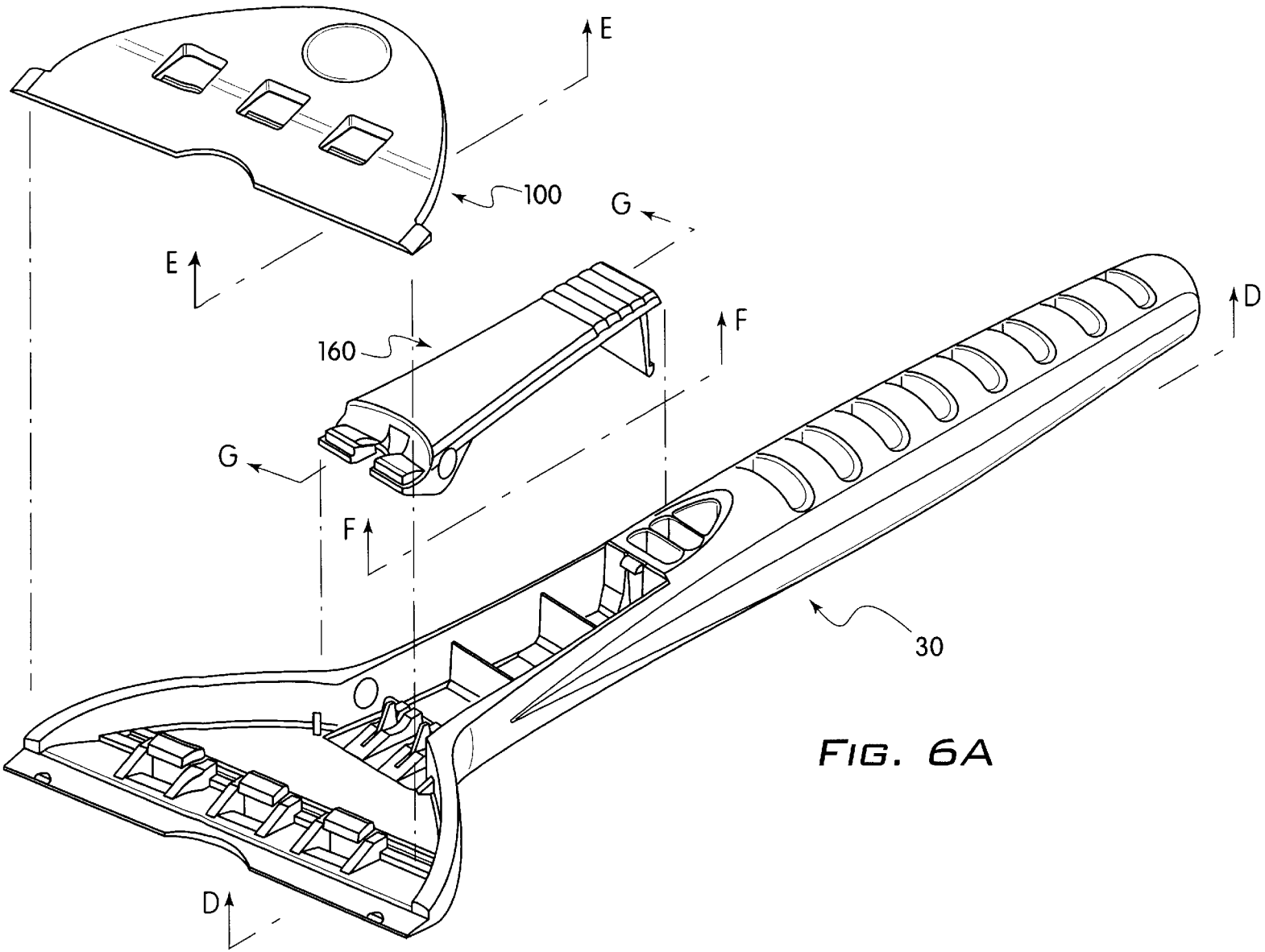
FIG. 6A is an exploded perspective view of the Tool, showing its three primary components: integral body/handle, blade clamp and latching lever.
Figure 6B:
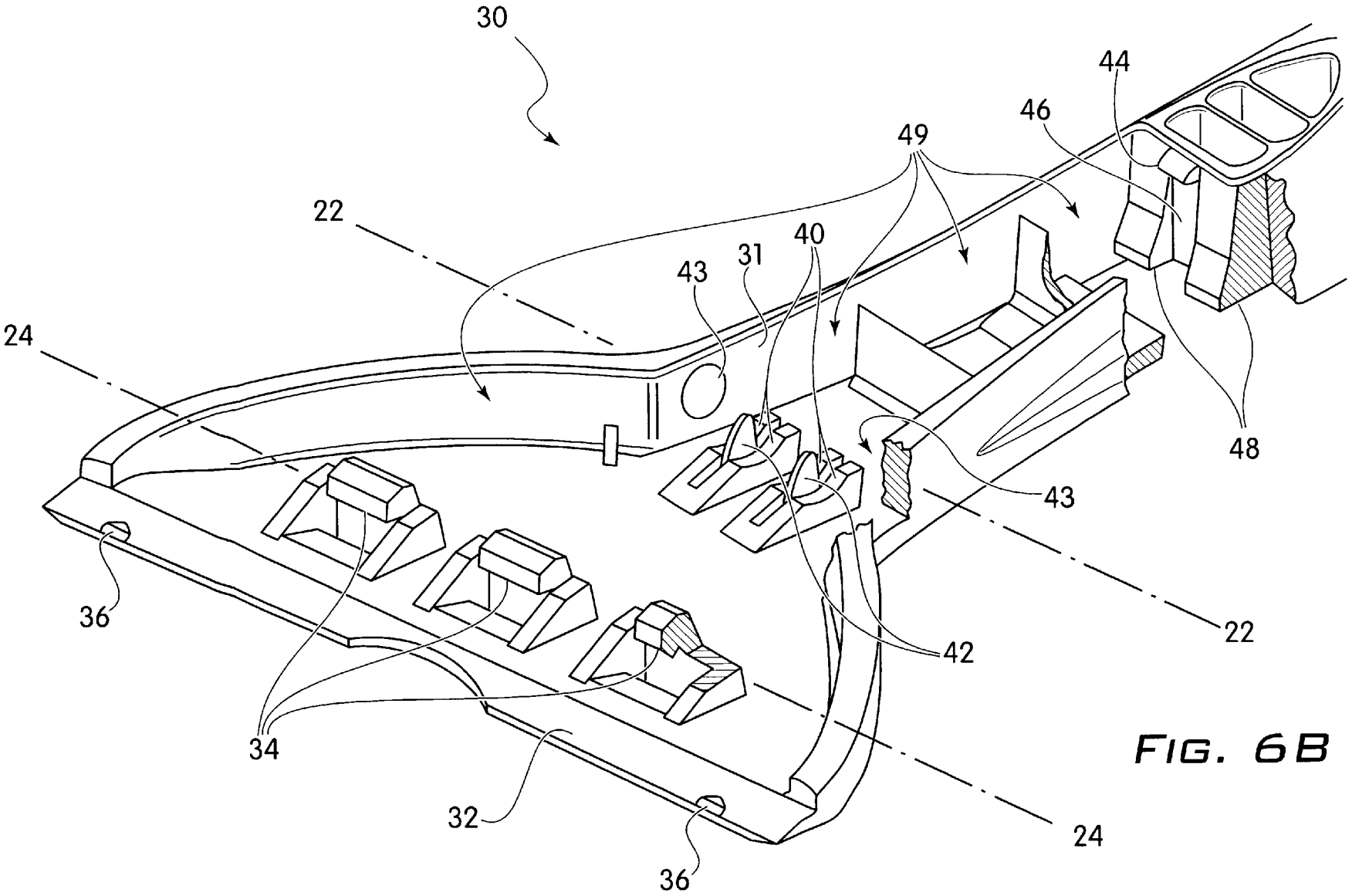
FIG. 6B is an enlarged perspective view of the body/handle with cut away sections of the body portion.
Figure 6C:
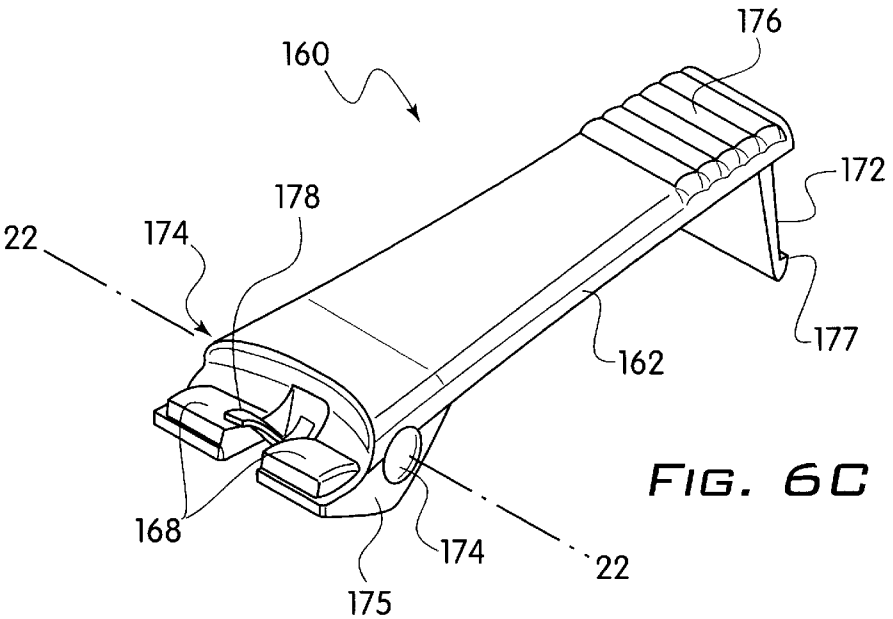
FIG. 6C is a perspective view of the latching lever.
Figure 10:
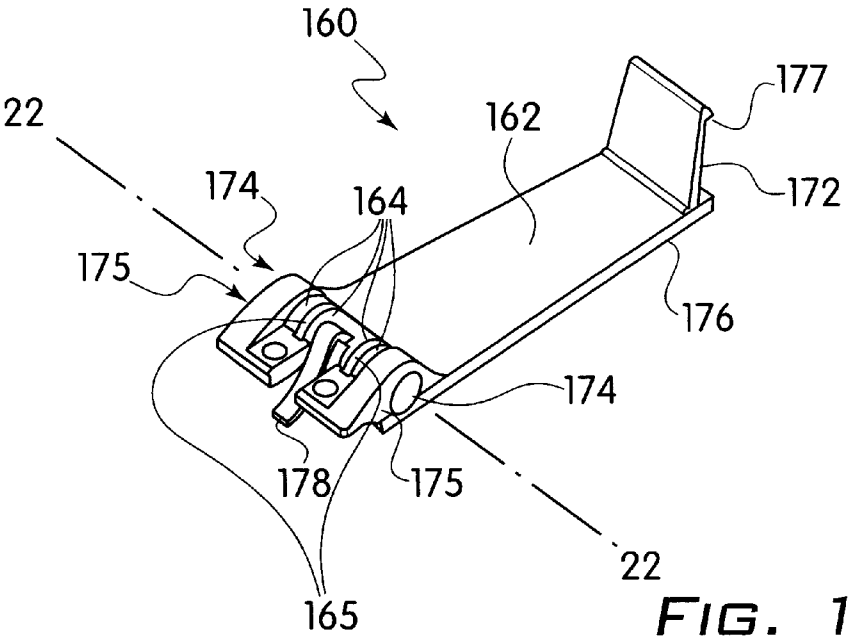
FIG. 10 is a perspective view of the latching lever view F—F from FIG. 6A.
Figure 11A:
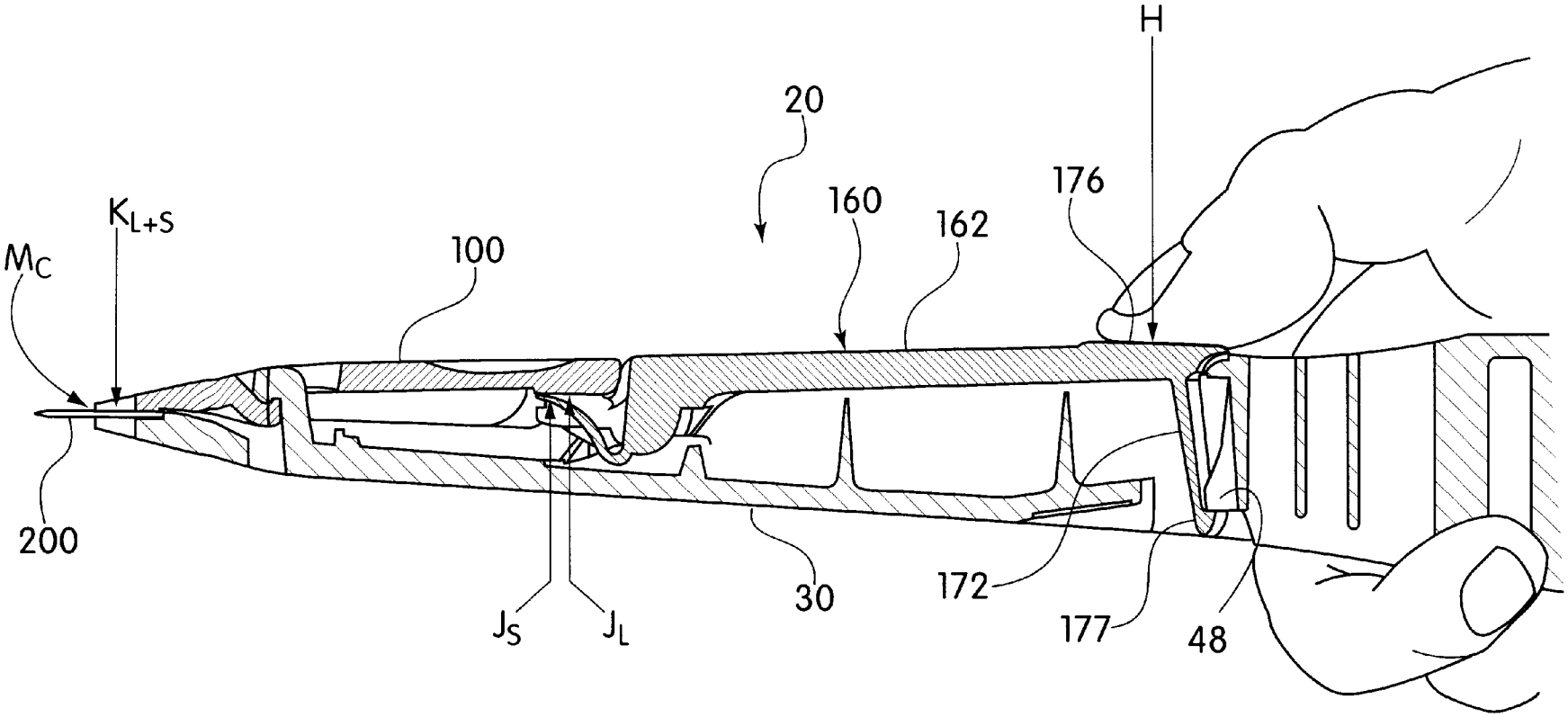
FIG. 11A shows the user locking the blade clamp by depressing the thumb rest at the end of the latching lever, enabling the "ready-to-use" position (Section A—A from FIG. 2).
Figure 12:
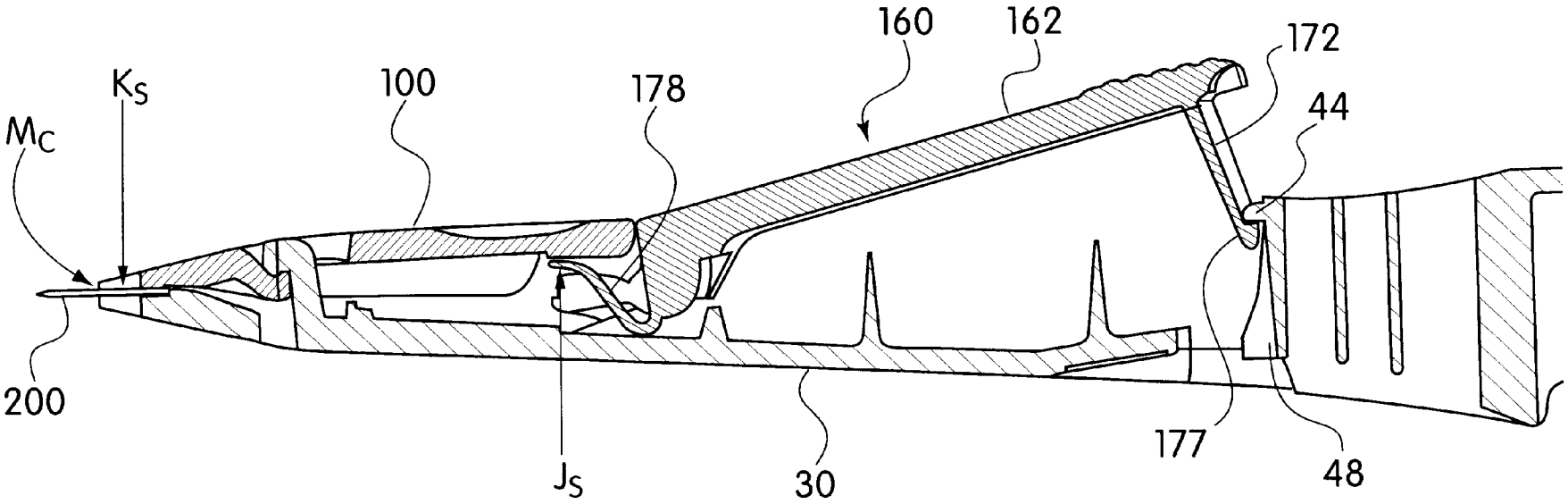
FIG. 12 is longitudinal Section B—B from FIG. 4 depicting the unlatched locking lever, but with the blade still retained by the fully closed clamp.

As best shown in FIGS. 6C and 10, lever 160 incorporates a pair of convex protrusions 174 or second pivot means on lateral flanks 175 that, during assembly, "snap" into cooperating concave depressions 43 in opposing inner body sidewalls 31 or first pivot means, best shown in FIG. 6B. Lever 160 is thus able to pivot about lever pivot axis 22 between the latched position (FIGS. 2 and 11A) and the unlatched intermediate mode or position (FIGS. 4 & 12). Convex protrusions 174 and depressions 43 could, of course, be employed in reverse juxtaposition. Other configurations could be utilized to allow for the rotation of lever 160 relative to body 30 such as pins, axles, hinges or other pivot means.

Figure 5:
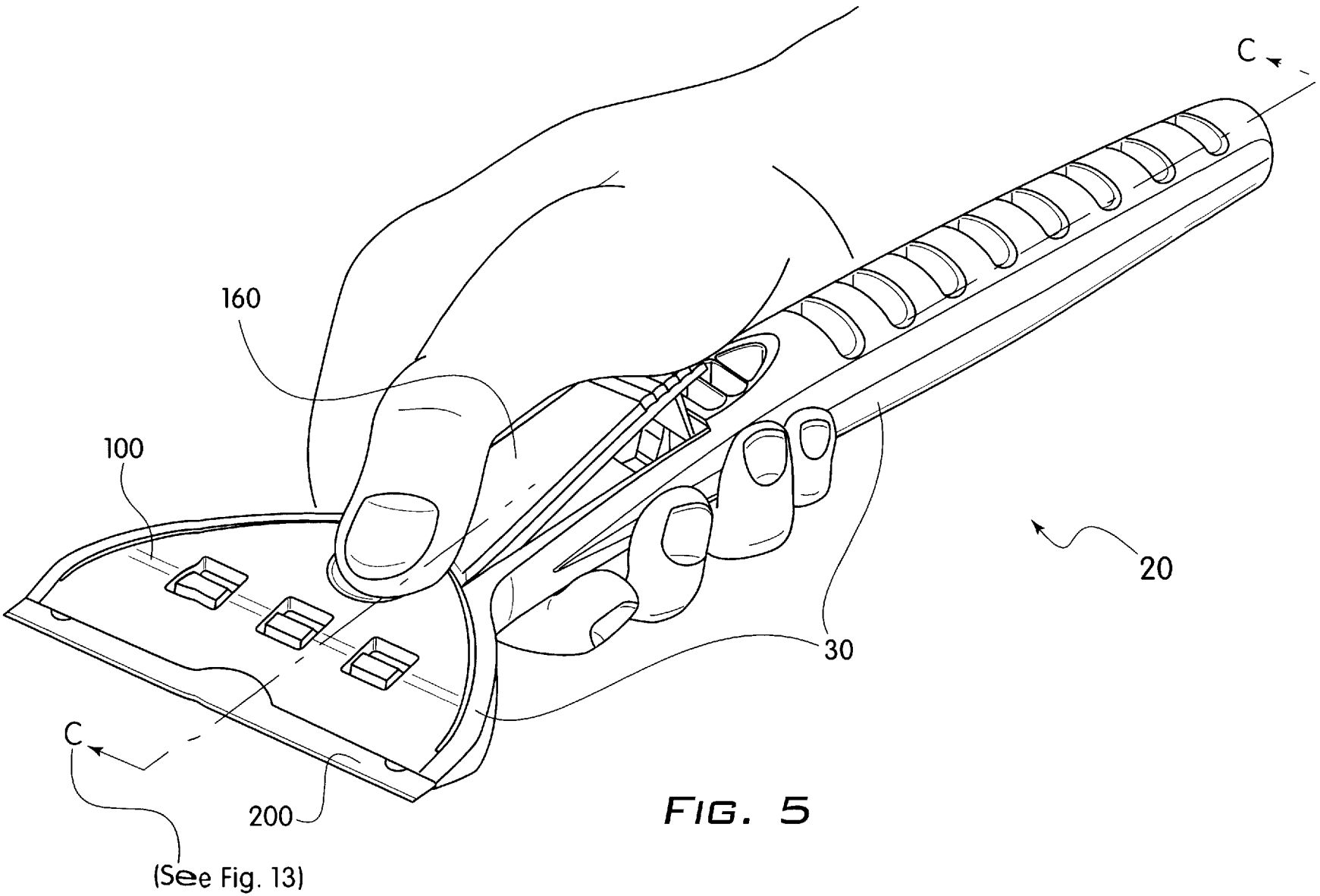
FIG. 5 is similar to FIG. 4 except the user is shown depressing the thumb rest on the rear portion of the clamp to spread the clamping surfaces that grip the blade, preparatory to removal.
Figure 13:
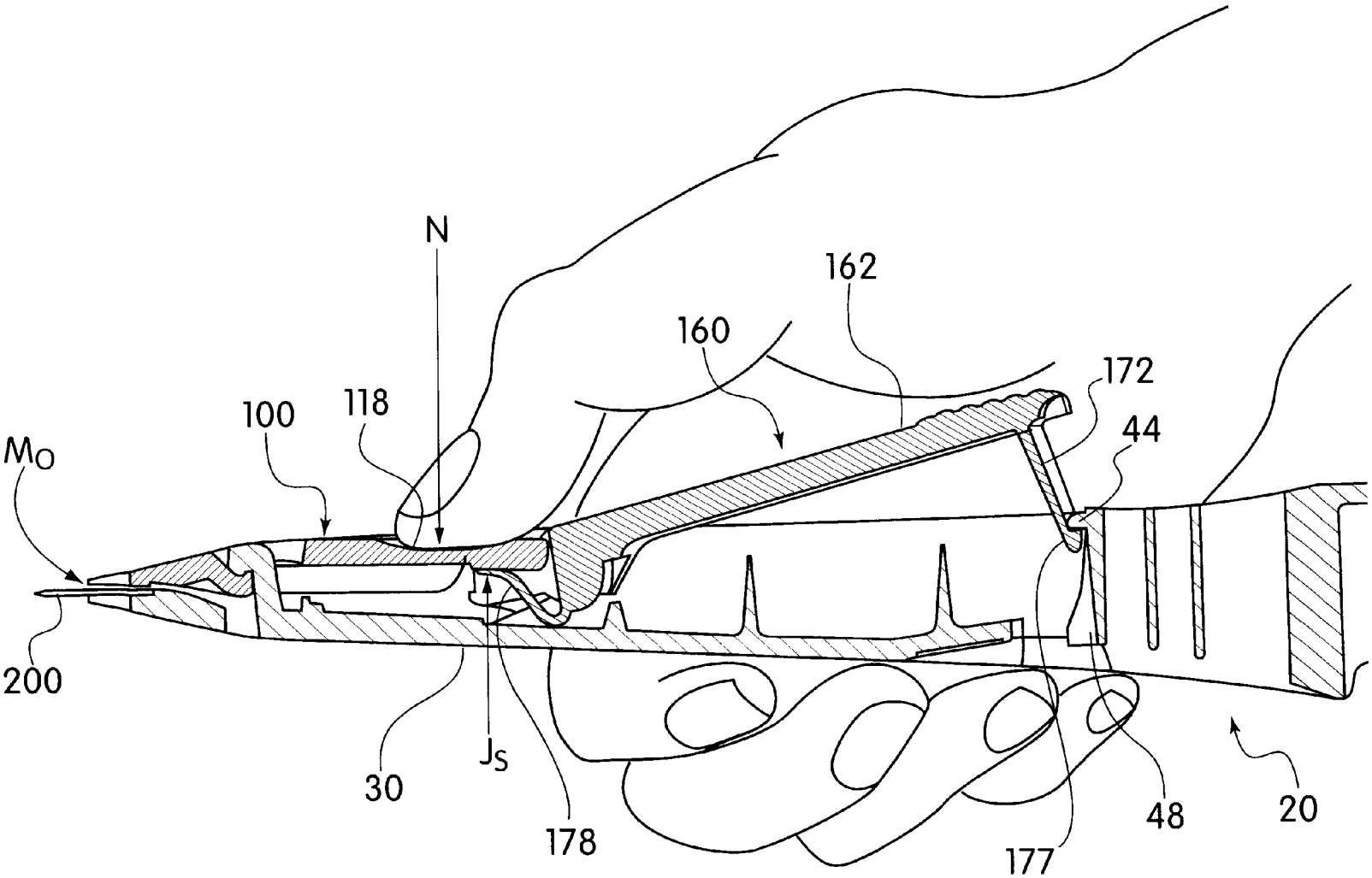
FIG. 13 shows the user actuating the clamp into the blade removal or storage position, with the tool shown in cross section, Section C—C, FIG. 5.

The position of latching lever 160 remains the same in FIG. 5 and 13, as it was in FIGS. 4 and 12. The former figures differing only in the addition of the user's hand to depict blade clamp 100 actuation (for the purpose of removing or installing blade 200). Additional support for latching lever 160 is cooperatively provided by a pair of cylindrical bearing surfaces 164 (FIG. 10) that interface with a pair of mating bifurcated bearing seats 40 in body 30, FIG. 6B, forming a lever pivot means. A pair of sail-like projections 42 rise from bearing seats 40, mating loosely with a pair of guide slots 165 in bearing surfaces 164 (FIG. 10). Although projections 42 and guide slots 165 cooperatively provide longitudinal stability for latching lever 160, they are not essential to this embodiment of the invention.

Figure 9:
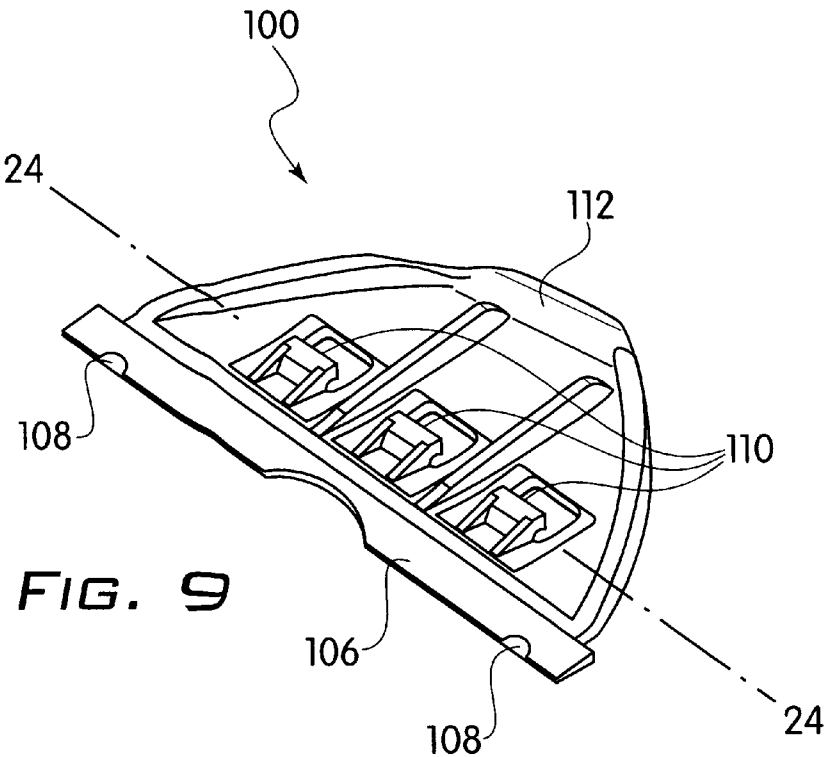
FIG. 9 is a perspective of the blade clamp view E—E from FIG. 6A.

Lever 160 incorporates a bifurcated contact platform 168 (FIGS. 6C and 7) for closing blade clamp 100 on blade 200. Contact platform 168 is positioned on the forward side of lever pivot axis 22 (nearer the blade end 27 of tool 20) (FIG. 6C). A downward thrusting force H by the user (FIG. 11A) on lever thumb rest 176 (FIGS. 6C and 7), which is located rearward of lever pivot axis 22 (at the distal end of horizontal lever beam 162), causes contact platform 168 to exert upward force $J_L$ (FIG. 11A) on cooperating contact pad 112. Cooperating contact pad 112 is disposed on the rear underside portion of blade clamp 100 (FIG. 9). Lever 160, in the preferred embodiment, provides an approximate 5 to 1 (5:1) leverage by the virtue of the relative distances of the lever thumb rest 176 and contact platform 168, respectively, from lever pivot axis 22. Other leverages, more or less, are feasible, but the combined mechanical advantage of lever 160 and blade clamp 100 of the preferred embodiment is approximately ten to one (10:1).

Figure 6D:
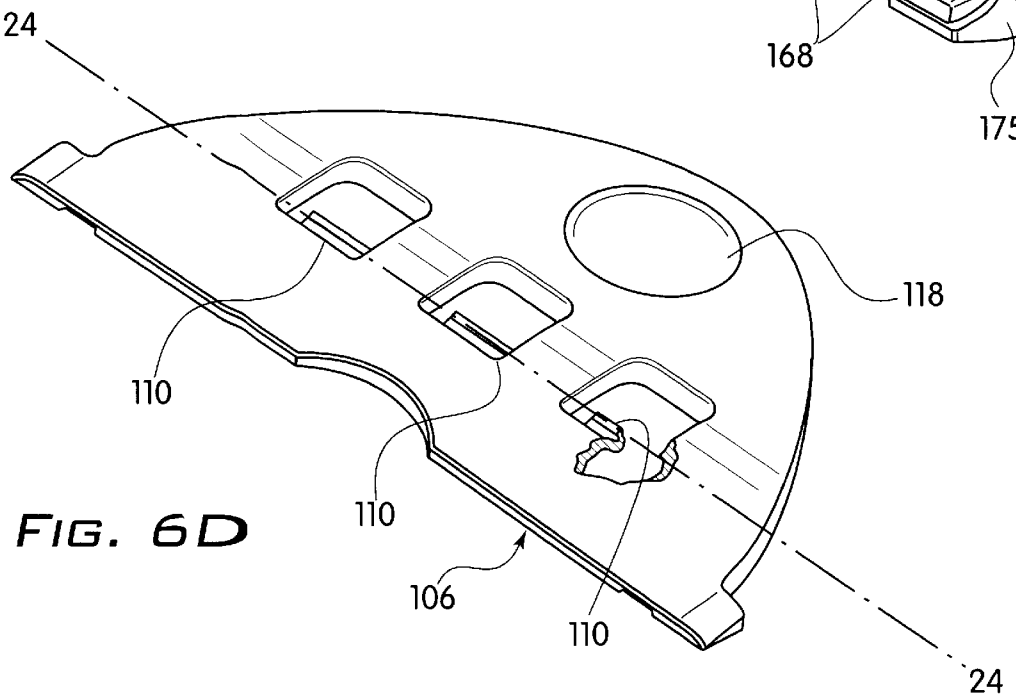
FIG. 6D is a perspective view of the blade clamp with cut away section.
Figure 7:
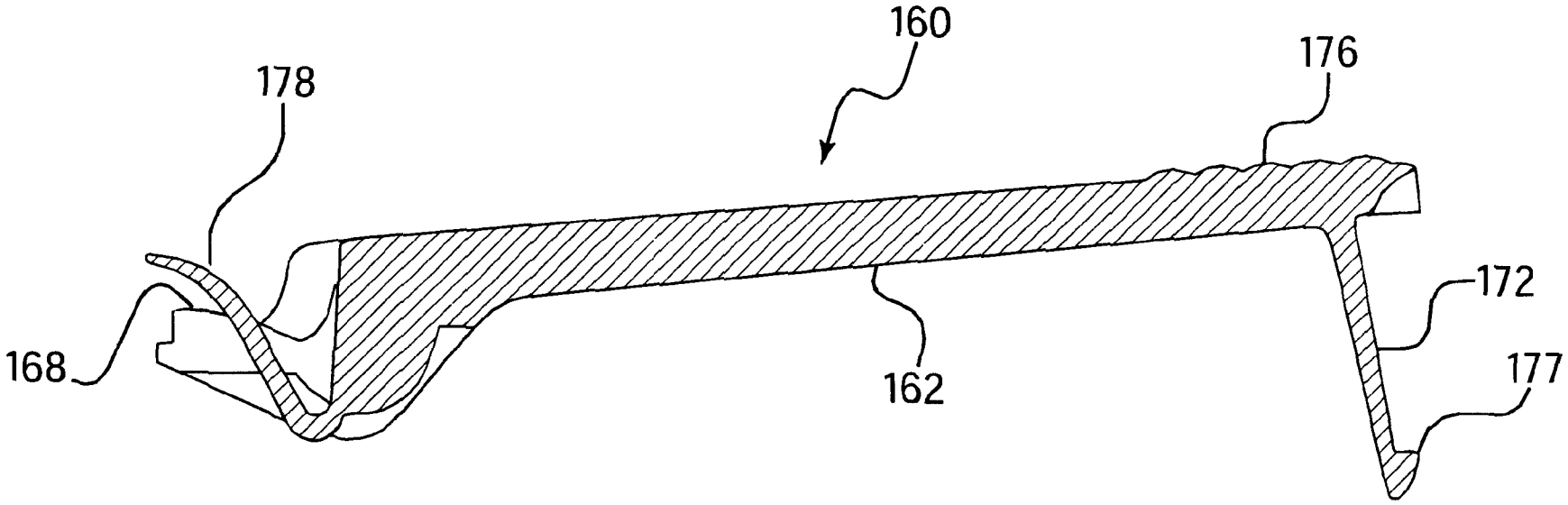
FIG. 7 is a longitudinal cross section of the latching lever (Section G—G from FIG. 6A).
Figure 8:
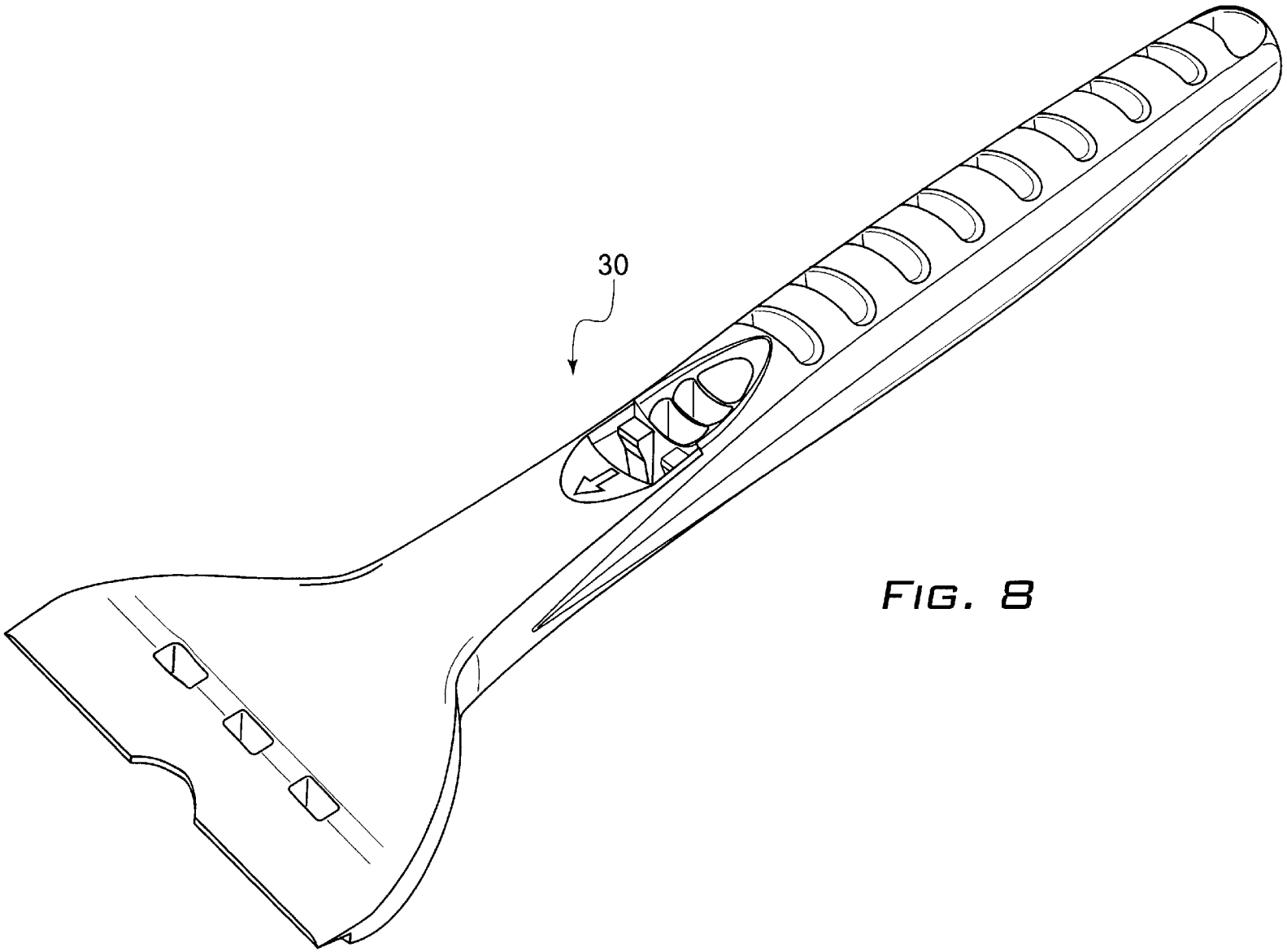
FIG. 8 is a perspective view of the body bottom in view D—D from FIG. 6A.

A resilient appendage 178, shaped like the spout of a tea kettle, between bearing surfaces 164 (FIG. 10), and emanates from the bottom surface of lever 160 and arches upward through the bifurcation in contact platform 168 (FIGS. 6C, 7 and 10). Appendage 178 presses against contact pad 112 (FIG. 9) of blade clamp 100 with force $J_S$, as depicted in FIGS. 11A, 12 and 13. Appendage 178 is essentially a cantilevered leaf spring. Appendage 178 is configured, on one hand to exert sufficient pressure on contact pad 112 to maintain blade clamp 100 closure (and, therefore, blade 200 retention) whenever lever 160 is unlatched or in the intermediate position, (FIGS. 4 and 12). On the other hand, appendage 178 offers little resistance when the user actuates blade clamp 100 (FIGS. 5 and 13) into the blade removal or storage position. Thus, blade 200 is under control at all times, being retained by blade clamp 100 until purposefully released by the user, who needs only depress the clamp with minimal force N, (FIG. 13) applied on designated clamp thumb rest 118 (FIG. 6D). Upon latching of lever 160 (FIG. 11A), spring force $J_S$ combines with upward force $J_L$ to effect closure of blade clamp 100. Force $J_S$'s minimal contribution, however, is of no import in this mode, since it's primary function is to retain blade 200 whenever lever 160 is unlatched (FIG. 12).

Although resilient appendage 178 is integral with lever 160 in the preferred embodiment of Tool 20, alternative embodiments could combine appendage 178 with blade clamp 100 or body 30, or appendage 178 could be a separate component. In the latter case, resilient appendage 178 could be manufactured from a variety of different plastics, rubbers, metals etc.

Restraint of lever 160 in body/handle 30 is cooperatively provided by the lever 160 and body/handle 30. Latching lug 177, or latching means, at the distal end of vertical lever extension 172 (FIGS. 6C, 7 and 10) engages its counterpart, lower bifurcated latching detent 48, or lower latch engagement means (FIG. 6B) on body 30 whenever the user fully depresses lever 160 (FIG. 11A). Lower detent 48 is the lower of two detents protruding from backwall 46 of body cavity 49 (FIG. 6B), and is bifurcated for tooling considerations to allow molding of upper latching detent 44, or upper latch engagement means. The purpose for upper latching detent 44 (FIG. 6B) is to catch latching lug 177 (FIGS. 6C, 7 and 10) as lever 160 pivots upward upon being released (FIGS. 4 and 12). This prevents latching lug 177 from escaping body cavity 49 so as to retain the assembly of lever 160, blade clamp 100 and body 30 (by limiting the pivot angle of lever 160 as it rotates counterclockwise). Obviously, alternative embodiments could incorporate other methods and devices for engaging latching lug 177 with lower latching detent 48 and alternatively upper latching detent 44.

Figure 2:
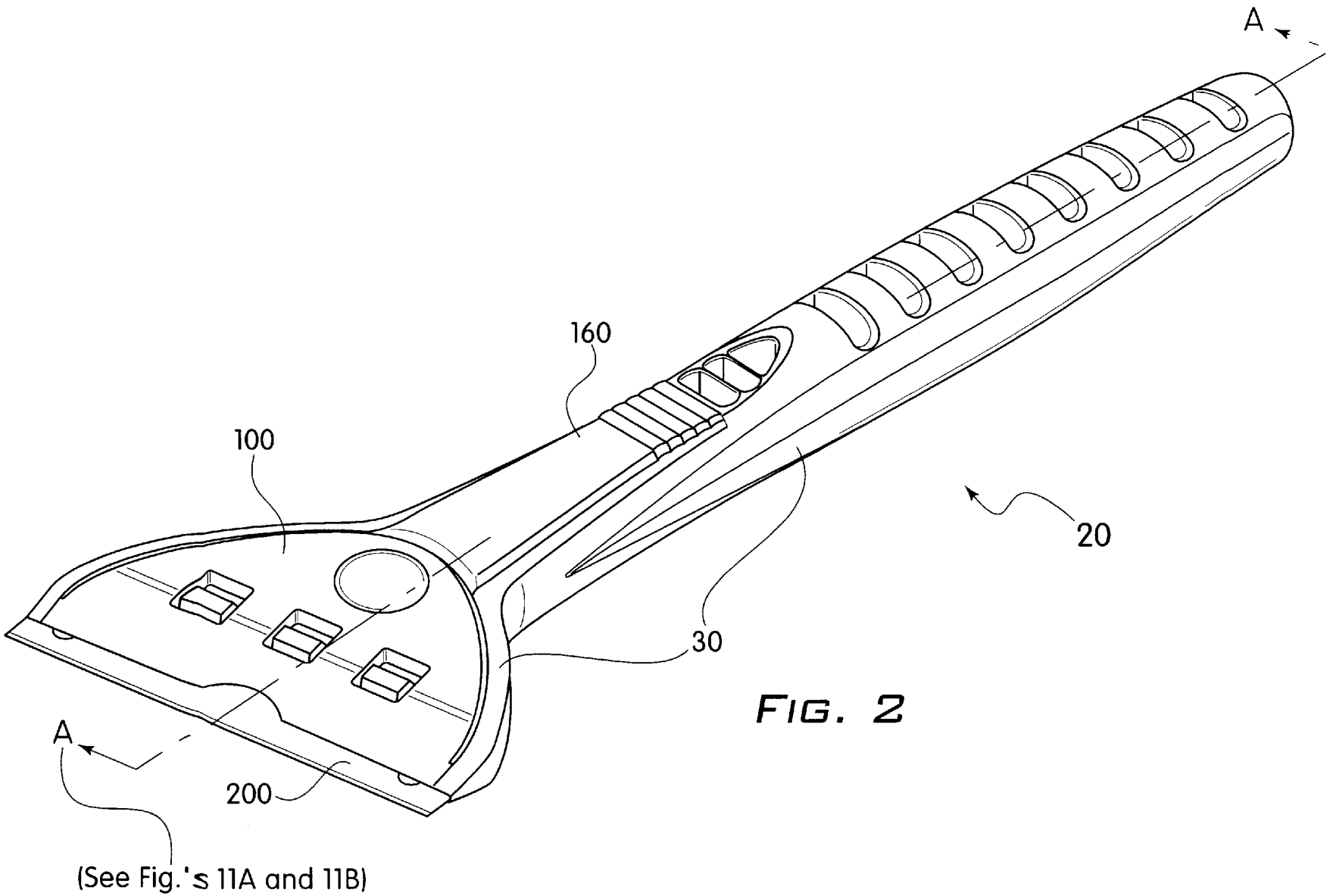
FIG. 2 is a top, front, left-side perspective view of the Tool "ready-to-use", as in FIG. 1.

The primary closing force $K_S$ (FIG. 12) on blade clamp 100 emanates from the spring tension stored in horizontal lever beam 162 (FIGS. 6C, 7 and 10) when fully latched (FIGS. 2 and 11A). The downward thrust of the user's thumb on lever thumb rest 176 requires force H (FIG. 11A) to deflect lever beam 162 the required, predetermined amount for successful latching. The resulting upward force $J_L$ imposed by lever contact platform 168 on clamp contact pad 112 is sufficient, through the leverage of blade clamp 100, to retain blade 200 between the upper blade clamping lip 106 or first clamping means and lower blade clamping lip 32 or second clamping means, (FIGS. 9 and 6B).

Blade clamp 100 has a mechanical advantage of 2:1 resulting from the relative distances, respectively, of contact pad 112 and upper blade clamping lip 106 (FIG. 9) from clamp pivot axis 24 (FIGS. 6D and 9). When combined with lever 160 mechanical advantage (5:1), the overall leverage of the lever 160 and blade clamp 100 combination, as previously noted, is approximately 10:1. Total blade retaining force $K_{L+S}$ (FIG. 11A) is, therefore, approximately ten times that of force H, which the user must apply in order to latch lever 160 when locking the clamp in the closed position $M_C$ (FIG. 11A). The resulting friction forces on both the upper and lower surfaces of blade 200, FIG. 11A, ($K_{L+S}$ is opposed by an equal, upward acting force, not shown) are sufficient to retain the blade 200 between upper blade clamping lip 106 and lower blade clamping lip 32 when the tool is being used for its intended purpose.

The pair of blade interlocking projections 36 (FIG. 6B) on lower blade clamping lip 32 of body 30, and the cooperating pair of mating holes 210 in blade 200 (FIG. 14), are optional, and are not essential for blade retention when tool 20 is performing its intended function. Upper blade clamping lip 106 of blade clamp 100 includes a pair of recesses 108 (FIG. 9) that provide clearance for projections 36, the latter fully penetrating blade 200; extending slightly above its upper surface and into recesses 108 of blade clamping lip 106.

Figure 3:
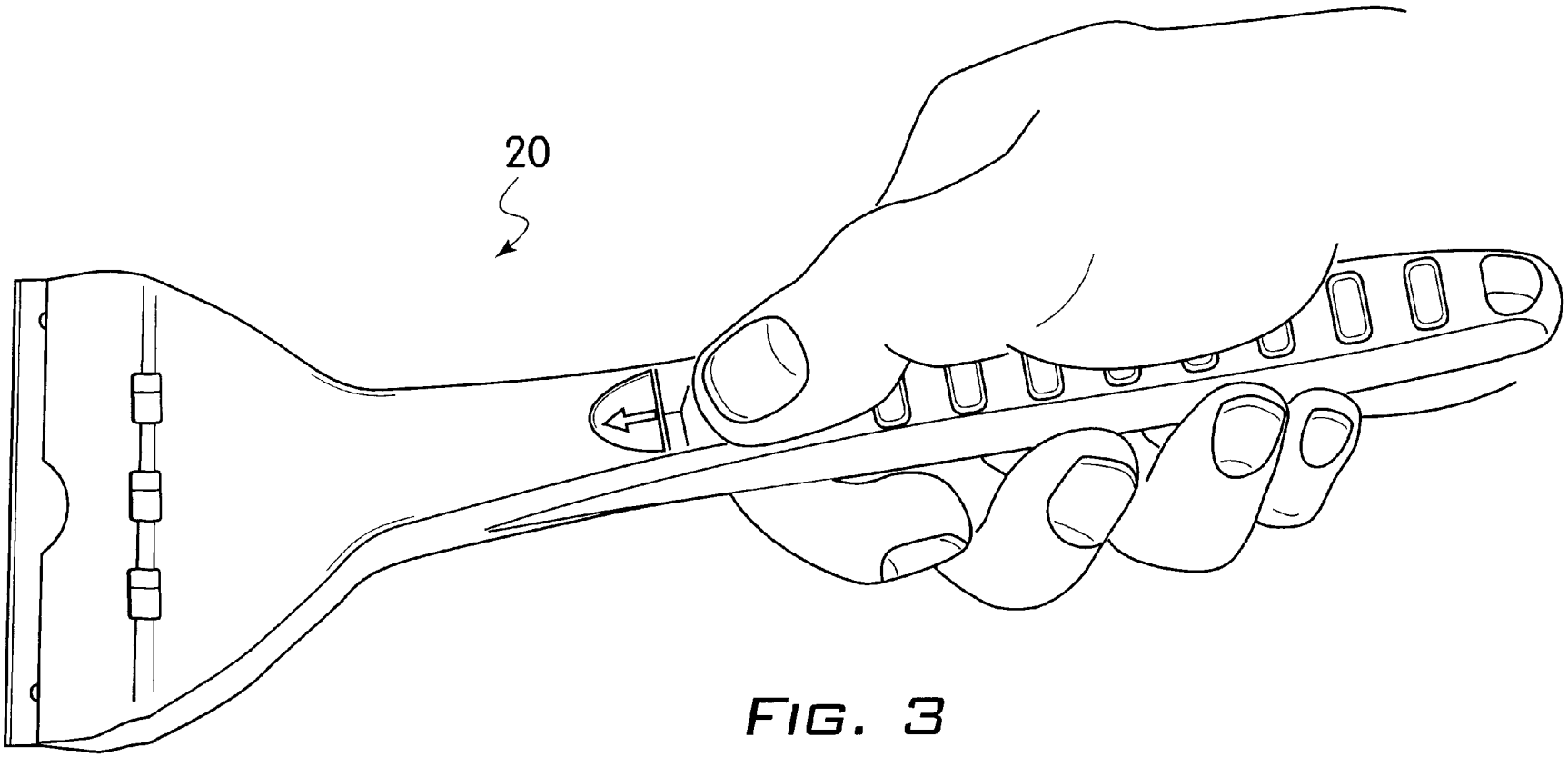
FIG. 3 is a bottom right-side perspective view of the Tool showing the user actuating the latching lug to unlock the blade clamp.
Figure 11B:
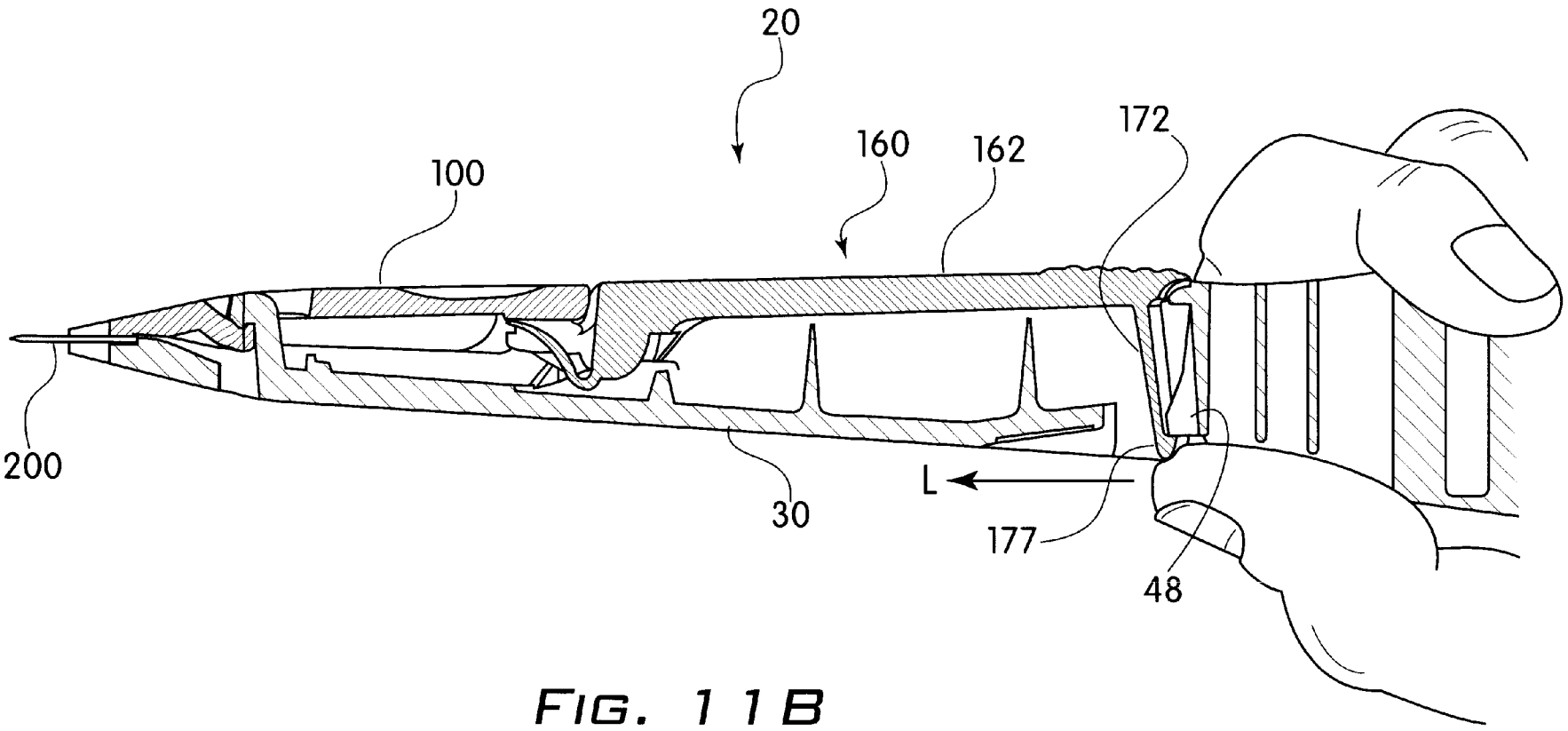
FIG. 11B is also Section A—A from FIG. 2, but with the user shown unlatching the lever, thereby unlocking the blade clamp (as in FIG. 3).

Blade 200 release is augmented by first unlatching lever 160 from the body 30, FIG. 3 and 11B. The user must forwardly thrust latching lug 177 (FIGS. 6C, 7) the distance required (not shown) to disengage latching lug 177 from lower latching detent 48 (FIG. 11B). Lever extension 172 (FIGS. 6C and 7) is configured to deflect sufficiently for this purpose in response to a nominal force L (FIG. 11B) applied by the user to latching lug 177 in a direction towards the blade clamp 100.

Once disengaged from lower latching detent 48, lever 160 pivots upward as the stored spring tension in lever beam 162 (FIG. 12) is released. Lever 160 pivots counterclockwise (as viewed in FIGS. 11B and 12) around pivot axis 22 (FIG. 6C) until its motion is arrested by engagement of latching lug 177 with upper detent 44 (FIG. 6B) as depicted in FIG. 12. Blade 200 remains retained, as previously described, until the user purposefully actuates blade clamp 100 as shown in FIGS. 5 and 13, causing upper blade clamping lip 106 and lower blade clamping lip 32 to part sufficiently, forming gap $M_O$ (FIG. 13) permitting blade 200 removal or insertion.

Blade clamp 100 (FIGS. 6D and 9), like lever 160, and subsequent to said lever 160 assembly, is also assembled by "snap fit" to body 30 (FIG. 6B). Cooperatively engaging trifurcated clamp hinge 110 or second hinge means (FIGS. 6D and 9) and trifurcated body hinge 34 or first hinge means (FIG. 6B) in blade clamp 100 and body 30, respectively, not only retain their mutual attachment, but also provide the necessary pivotability about clamp pivot axis 24 (FIGS. 6B and 6D) to allow opening ($M_O$) and closing ($M_C$) of blade clamp 100 as shown in FIGS. 13 and 11A, respectively. The preferred embodiment of this invention employs trifurcated clamp hinge 110 and trifurcated body hinge 34, respectively for structural and molding convenience. Other configurations are feasible, such as bifurcated or continuous hinge designs or structural equivalents.

Lever 160 is installed in body cavity 49 (FIG. 6B) by first positioning lever 160 slightly above the cavity while aligning convex protrusions 174 (FIGS. 6C and 10) with opposing body sidewalls 31 concave depressions 43 (FIG. 6B). A nominal amount of downward force applied to the forward end of lever beam 162 (FIGS. 6C and 10) will overcome the slight predetermined interference fit between the overall width of latching lever 160 across convex protrusions 174 and the interior body cavity 49 sidewall 31 to sidewall 31 distance just above concave depressions 43. Upon "seating" of the convex protrusions 174 in the concave depressions 43, lever 160 has assumed an angle such that latching lug 177 has remained just above and, thus, still disengaged from upper latching detent 44.

Blade clamp 100 is then installed by first placing it into the forward portion of body cavity 49 (FIG. 6B) so that trifurcated clamp hinge 110 of blade clamp 100 and trifurcated body hinge 34 of body 30 abut, but not yet engage each other. A nominal amount of rearwardly applied longitudinal force on the leading edge of upper blade clamping lip 106 will overcome the slight predetermined interference fit between the height of clamp hinge 110 and the height of the opening just forward of body hinge 34 that provides access for clamp hinge 110.

Upon seating blade clamp 100, lever 160 is depressed so that lever latching lug 177 engages at least the upper latching detent 44 on body cavity backwall 46, which assures retention of the three assembled components. Lever 160 may then be further depressed so that latching lug 177 engages the lower, bifurcated, latching detent 48 on body backwall 46, closing and locking blade clamp 100 preparatory to using the Tool 20 for its intended purpose (that is, of course, whenever blade 200, FIG. 14, has been installed in its working position; sharp edge 220 exposed). When Tool 20 is not in use, blade 200 position is reversed to expose its dull, blunt edge 230 (blade storage position), or blade 200 may be removed entirely and stored in a suitable container until the next use.

Figure 14:
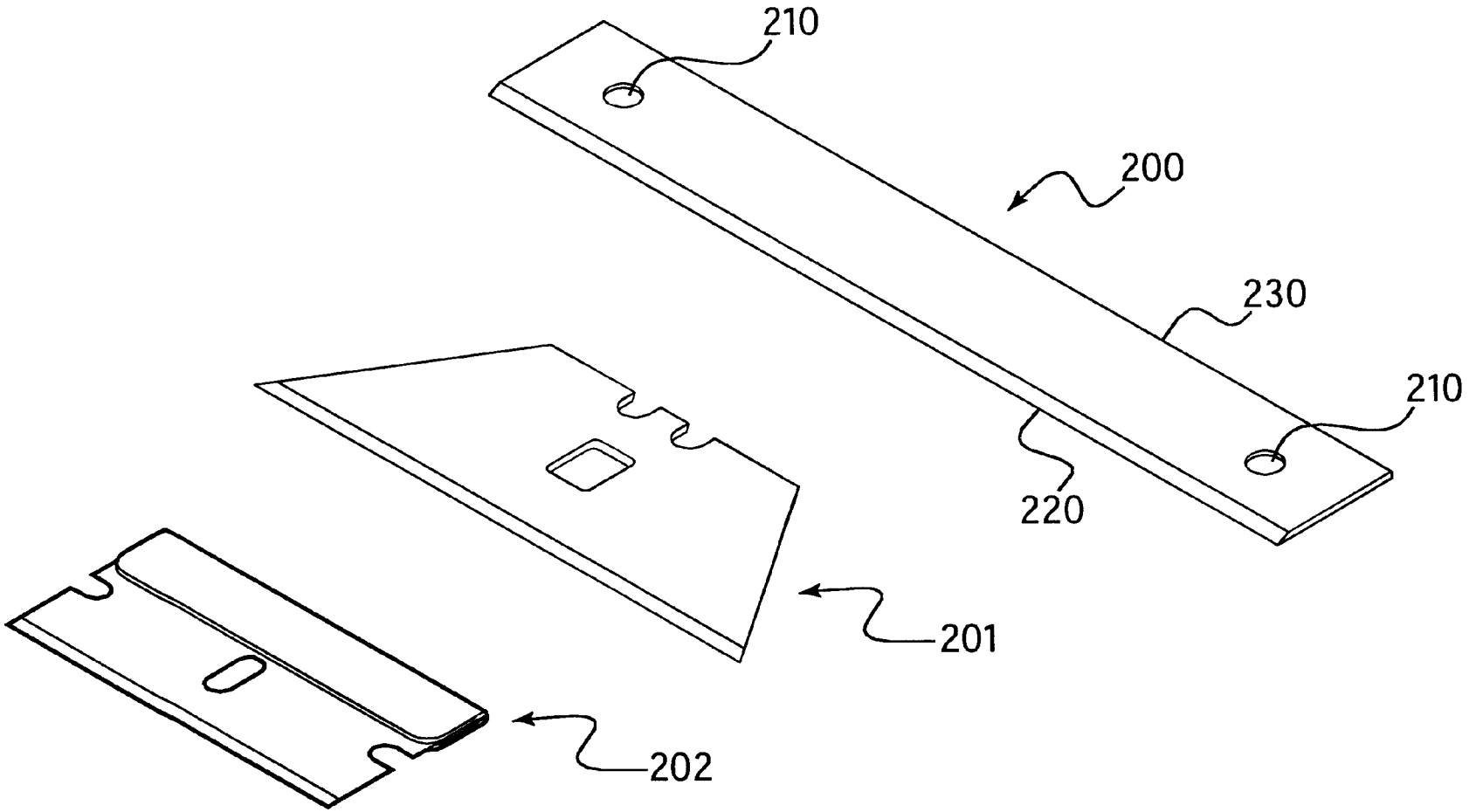
FIG. 14 depicts three common types of blades employed by scraping tools. From upper right to lower left; the wallpaper shaver blade, for which the preferred embodiment of this invention is specifically adapted; alternative embodiments could utilize the trapezoidal utility blade, single edge razor blade or almost any type of scraping blade.

Needless to say, this invention applies to innumerable blade types and styles, including the familiar utility blade 201 and single-edge razor blade 202 (FIG. 14).

It will now be apparent to those skilled in the art that other embodiments, improvements, details and uses can be made consistent with the letter and spirit of the foregoing disclosure and within the scope of this patent, which is limited only by the following claims, construed in accordance with the patent laws, including the doctrine of equivalents.

What is claimed is:

1. A scraping tool with replaceable blade and controlled quick-release clamp, the tool comprising:

an elongate integral body having on one end a first clamping means for receiving, restraining and releasing a blade, and at the other end a handle means for operating said tool, a first hinge means near the first clamping means for receiving a mating second hinge means of a blade clamp having a second clamping means, said first and said second hinge means cooperating to provide attachment of the blade clamp and the body and pivotability of the blade clamp relative to the body to access the blade, a first pivot means between the first hinge means and the handle means for receiving a second pivot means of a lever, the first and the second pivot means cooperating to provide attachment of the lever to the body and pivotability of the lever to actuate the blade clamp, at least one latch engagement means in the body between the first pivot means and the handle means for receiving a latching means of the lever, the body and the latching means cooperating when engaged to lock the lever and the blade clamp in a closed position;

the lever having on one end at least one contact platform for actuating the blade clamp, at an opposite end a lever thumb rest for actuating the latching means into engagement with said at least one latch engagement means, the second pivot means between the contact platform and the lever thumb rest for cooperating with the first pivot means, the latching means near the thumb rest for cooperating with said at least one latch engagement means;

the blade clamp having on one end the second clamping means and on the opposite end a clamp thumb rest for manually actuating the clamp to access the blade, the second hinge means between the second clamping means and the clamp thumb rest for cooperatingly interengaging with the first hinge means, a contact pad located beneath the clamp thumb rest for receiving thrust from said at least one contact platform;

at least one resilient appendage to bias the first clamping means and the second clamping means into a closed position with sufficient force to retain the blade against the force of gravity, when the latching means of the lever and the latch engagement means of the body are not engaged;

whereby the combined mechanical advantage of the lever and the clamp is at least approximately ten to one, said mechanical advantage augmenting a retaining force on the first and the second clamping means of approximately ten times the force applied on the lever thumb rest when the latching means and the latch engagement means are urged into full engagement, said retaining force being at least approximately one hundred pounds; and whereby the force required to unlatch the latching means from the latch engagement means is no more than approximately ten pounds.

2. The scraping tool with replaceable blade and controlled quick-release clamp of claim 1, further comprising:

a second latch engagement means formed of an upper latching detent in the body near a top surface of the body.

3. The scraping tool with replaceable blade and controlled quick-release clamp of claim 1, wherein:

the first clamping means is a lower blade clamping lip having at least one projection for aligning and retaining the blade.

4. The scraping tool with replaceable blade and controlled quick-release clamp of claim 1, wherein:

the first hinge means is a three part body hinge interengaging the second hinge means which is a three part clamp hinge.

5. The scraping tool with replaceable blade and controlled quick-release clamp of claim 1, wherein:

the second clamping means is an upper blade clamping lip for retaining the blade having at least one recess for surrounding a corresponding number of projections.

6. The scraping tool with replaceable blade and controlled quick-release clamp of claim 1, wherein:

the first pivot means is a pair of concave depressions one in each of a sidewall of said body and the second pivot means is a pair of convex protrusions one on each of a lateral flank of said lever.

7. A scraping tool for releasably retaining a blade, said tool comprising:

a body having a lower blade clamping lip on one end, the body having a cooperatively interengaging first hinge means for rotatable attachment of a latching lever to the body, and a cooperatively interengaging second hinge means for rotatable attachment of a blade clamp to the body;

said latching lever having a latching lug on one end for engagement with an upper latch engagement means in the body when the tool is in an intermediate and a blade removal or storage position, the latching lug alternatively engaging a lower latch engagement means in the body in a working position, the latching lever having a plurality of contact platforms and a resilient appendage on one end, and a lever thumb rest and the latching lug on the opposite end;

the blade clamp having a blade thumb rest and a contact pad on one end of the clamp for engagement with the contact platforms and the resilient appendage, the blade clamp having an upper blade clamping lip for engaging a blade in the working position on an opposite end of the clamp;

the latching lever rotatable around the first hinge means to engage the latching lug with the lower latch engagement means, rotation of the latching lever around the first hinge means causing the contact platforms and the resilient appendage to contact the contact pad in turn causing the blade clamp to rotate around the second hinge means resulting in contact of the upper blade clamping lip against the blade, the blade retained between the upper blade clamping lip and the lower blade clamping lip in the working position; and whereby manually releasing the latching lug from the lower latch engagement means and rotation of the latching lever results in the latching lug engaging with the upper latch engagement means, whereby the contact platforms disengage from the contact pad resulting in rotation of the blade clamp around the second hinge means, the resilient appendage remaining in contact with the contact pad providing a nominal amount of force to the blade clamp biasing the upper blade clamping lip and the lower blade clamping lip against the blade, whereby a user applied nominal force on the blade thumb rest causes compression of the resilient appendage resulting in rotation of the blade clamp around the second hinge means forming a gap between the upper blade clamping lip and the lower blade clamping lip to allow removal of the blade.

8. The scraping tool of claim 7 further comprising:

the first hinge means comprises a pair of adjacent bearing seats located on the body, a pair of concave depressions one on each of a pair of vertical side walls of the body, the bearing seats cooperatively interengaging with bearing surfaces located on the latching lever, the concave depressions cooperatively interengaging with a pair of convex protrusions located one on each lateral flank of the latching lever, a pair of projections adjacent the bearing seats for engaging corresponding slots in the latching lever.

9. The scraping tool of claim 7, wherein:

the second hinge means comprises a plurality of body hinges on the body for cooperatively interengaging a plurality of corresponding clamp hinges located on the blade clamp.

10. The scraping tool of claim 7, wherein:

the upper latch engagement means comprises an upper detent in the body near a top surface of the body for cooperatively interengaging with the latching lug when the tool is in the intermediate and blade removal or storage position.

11. The scraping tool of claim 7, wherein:

the lower latch engagement means comprises a pair of latching detents in the body, the latching detents extending from near an upper detent of the body, one on each side of the upper detent, to near a bottom surface of the body, the latching detents cooperatively interengaging the latching lug when the tool is in a working or ready to use position.

12. A scraping tool for releasably retaining a scraping or stripping blade, said tool comprising:

a body having a handle on one end and a lower blade clamping lip on a second end, a plurality of hinges located between the lower blade clamping lip and the handle, a plurality of bearing seats located between the hinges and the handle, a pair of exterior vertical walls one on each side of the bearing seats, the walls each having a concave depression, a pair of latching detents located between the bearing seats and the handle extending from a top surface of the body to near a bottom surface of the body, said latching detents bisected by an upper detent, said upper detent located near the top surface of the handle;

a latching lever having a lever extension extending from the latching lever approximately perpendicular for firstly engaging the upper detent and secondly engaging the latching detents, at least one contact platform extending from a forward end of the lever, a pair of bearing surfaces near said at least one contact platform and the lever extension for engaging the bearing seats of the body whereby the interface between the bearing surfaces and the bearing seats forms a lever pivot axis for rotation of the latching lever relative to the body, at least one resilient appendage extending from the forward end of the lever and terminating near said at least one contact platform, a pair of convex protrusions located one on each lateral flank of the lever, the convex protrusions for engagement in the concave depressions; and a blade clamp having a clamp thumb rest and at least one hinge for engagement to a corresponding body hinge whereby an interface between said at least one hinge and body hinge forms a clamp pivot axis for rotation of the blade clamp relative to the body, an upper blade clamping lip for selectively restraining a blade between the upper blade clamping lip and the lower blade clamping lip, a contact pad on an edge opposite the upper blade clamping lip for engagement of said at least one contact platform and the resilient appendage of the latching lever.

13. The scraping tool of claim 12, further comprising:

at least one projection on the lower blade clamping lip for aligning and retaining the blade, a corresponding number of recesses on the upper blade clamping lip for surrounding said at least one projection.

14. The scraping tool of claim 12 wherein:

the latching lever and the blade clamp snap fit into the body.

15. The scraping tool of claim 12 wherein:

the resilient appendage maintains a spring force on the contact pad thereby retaining the blade between the upper blade clamping lip and the lower blade clamping lip until a user applies a clamp opening force to the clamp thumb rest resulting in a blade gap permitting removal or insertion of the blade.

16. The scraping tool of claim 12 wherein:

the weight of the body, the latching lever and the blade clamp is no more than approximately 0.4 pounds.

* * * * *